US008210673B2

(12) United States Patent
Koike et al.

(10) Patent No.: US 8,210,673 B2
(45) Date of Patent: Jul. 3, 2012

(54) RECORDING APPARATUS

(75) Inventors: Kaoru Koike, Matsumoto (JP); Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 608 days.

(21) Appl. No.: 12/393,541

(22) Filed: Feb. 26, 2009

(65) Prior Publication Data

US 2009/0213202 A1 Aug. 27, 2009

(30) Foreign Application Priority Data

Feb. 27, 2008 (JP) ..... 2008-046342
Oct. 9, 2008 (JP) ..... 2008-262888

(51) Int. Cl.
*B41J 2/01* (2006.01)
*B41J 2/435* (2006.01)

(52) U.S. Cl. .... 347/104; 347/101; 347/262; 242/615.21

(58) Field of Classification Search ..... 347/104, 347/262; 242/615.21
See application file for complete search history.

(56) References Cited

U.S. PATENT DOCUMENTS 4,668,961 A * 5/1987 Hiramatsu ..... 347/214

FOREIGN PATENT DOCUMENTS

| | | |
|---|---|---|
| JP | 60-125690 | 7/1985 |
| JP | 09-254008 | 9/1997 |
| JP | 2002-154245 | 5/2002 |
| JP | 2003-094615 | 4/2003 |

* cited by examiner

*Primary Examiner* — Ryan Lepisto
(74) *Attorney, Agent, or Firm* — Workman Nydegger

(57) ABSTRACT

A recording apparatus includes: a first retainer and a second retainer arranged side by side in a thrust direction, the first and second retainers being rotatable and retaining a long recording medium wound therearound; a guide mechanism that draws the recording medium wound around the first retainer in the thrust direction and guides the recording medium in a direction in which the recording medium can be wound around the second retainer; and a recording unit that performs a first recording process on the recording medium wound in a single layer around and retained by the first retainer under rotation of the first retainer and a second recording process on the recording medium wound in a single layer around and retained by the second retainer under rotation of the second retainer.

3 Claims, 5 Drawing Sheets

RECORDING APPARATUS

BACKGROUND

1. Technical Field

The present invention relates to a recording apparatus that performs first and second recording processes on, for example, a long recording medium wound in a single layer around rotatable first and second retainers.

2. Related Art

As a recording apparatus that performs a recording process on a recording medium wound around the outer circumference of a body case (retainer), an ink jet printer (hereinafter, "printer") disclosed in Japanese Unexamined Patent Application Publication No. 2003-94615 is known. In the printer disclosed therein, a feeding roll (first shaft) and a take-up roll (second shaft) in which a roll medium (recording medium) is set are accommodated in a drum (body case), and the roll medium drawn from the feeding roll runs on the outer circumference of the drum to be taken up by the take-up roll. While the drum rotates, ink is discharged from a line head unit (recording unit) onto the roll medium provided on the outer circumference of the drum. Thus, printing (recording process) is performed on the roll medium.

In the printer disclosed in Japanese Unexamined Patent Application Publication No. 2003-94615, when the drum makes one rotation to complete printing on the roll medium provided on the outer circumference of the drum, a portion of the roll medium having undergone printing is taken up by the take-up roll. Therefore, it is impossible to eject an overcoat solution for protecting the printed surface onto the printed surface of the roll medium having undergone printing or to perform double-face printing, in which printing is also performed on the other surface of the printed surface of the roll medium having undergone printing.

SUMMARY

An advantage of some aspects of the invention is that it provides a recording apparatus capable of performing a plurality of recording processes on a long recording medium.

A recording apparatus includes: a first retainer and a second retainer arranged side by side in a thrust direction, the first and second retainers being rotatable and retaining a long recording medium wound therearound; a guide mechanism that draws the recording medium wound around the first retainer in the thrust direction and guides the recording medium in a direction in which the recording medium can be wound around the second retainer; and a recording unit that performs a first recording process on the recording medium wound in a single layer around and retained by the first retainer under rotation of the first retainer and a second recording process on the recording medium wound in a single layer around and retained by the second retainer under rotation of the second retainer.

In this configuration, the recording unit performs the first recording process on the recording medium wound in a single layer around and retained by the first retainer under rotation of the first retainer and the second recording process on the recording medium wound in a single layer around and retained by the second retainer under rotation of the second retainer. Accordingly, a plurality of recording processes can be performed on the long recording medium.

The recording apparatus of the invention further includes: a rotatable hollow body case having a plurality of communication portions providing communication between the inside and the outside; a first shaft that is accommodated in the body case and supports the recording medium wound in a roll shape in a manner that the recording medium can be fed from the inside to the outside of the body case through the communication portion positioned at the most upstream side of a transportation path of the recording medium among the communication portions; and a second shaft that is accommodated in the body case and is capable of taking up the recording medium introduced from the outside to the inside of the body case through the communication portion positioned at the most downstream side of the transportation path of the recording medium among the communication portions. The guide mechanism guides the recording medium introduced from the outside to the inside of the body case through the communication portion on the upstream side of the guide mechanism from the inside to the outside of the body case through the communication portion on the downstream side of the guide mechanism. The recording medium drawn from the inside to the outside of the body case through the communication portions is wound around separate regions of the outer circumference of the body case, the regions being arranged in the thrust direction, and introduced from the outside to the inside of the body case through the communication portions. The first retainer and the second retainer are formed of these regions of the outer circumference of the body case.

In this configuration, because the first retainer and the second retainer are formed of the separate regions of the outer circumference of the body case, the recording unit can perform the first recording process and the second recording process on the recording medium wound in a single layer around and retained by the first retainer and the second retainer under rotation of the body case.

In the recording apparatus of the invention, the guide mechanism is capable of reversing the recording medium so as to change the surface of the recording medium subjected to the recording processes at the retainers and is formed of a fold-over portion over which the recording medium is folded so as to change a transportation direction of the recording medium. The fold-over portion is formed of a roller rotatably supported about an axis.

In this configuration, because the recording medium can be reversed, the first recording process can be performed on one surface of the recording medium and the second recording process can be performed on the other surface of the recording medium. By folding the recording medium over the roller constituting the fold-over portion, the roller rotates along with the transportation of the recording medium. Thus, the recording medium folded over the roller can be smoothly guided from the first retainer to the second retainer.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

A first embodiment, which is a recording apparatus of the invention embodied as an ink jet printer, will be described below with reference to the drawings. The terms "front-rear direction", "left-right direction", and "top-bottom direction" in the following description correspond to those indicated by arrows in FIGS. 1 and 2.

Figure 1:
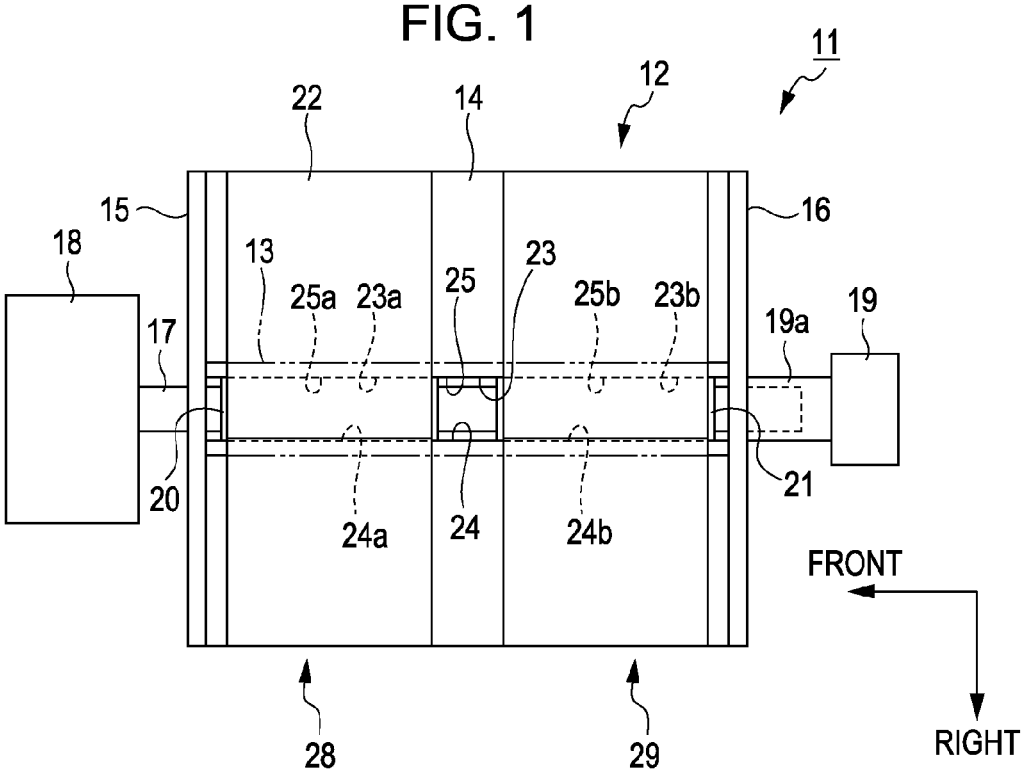
FIG. 1 is a plan view of an ink jet printer according to a first embodiment.
Figure 2:
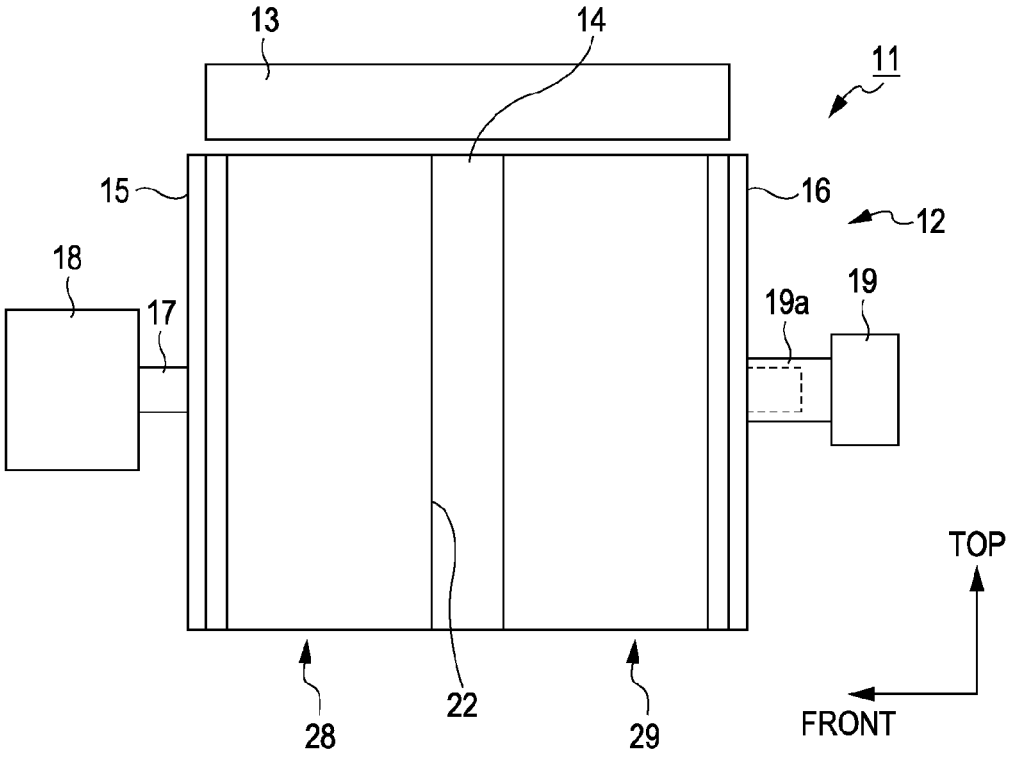
FIG. 2 is a front view of the printer.
Figure 3:
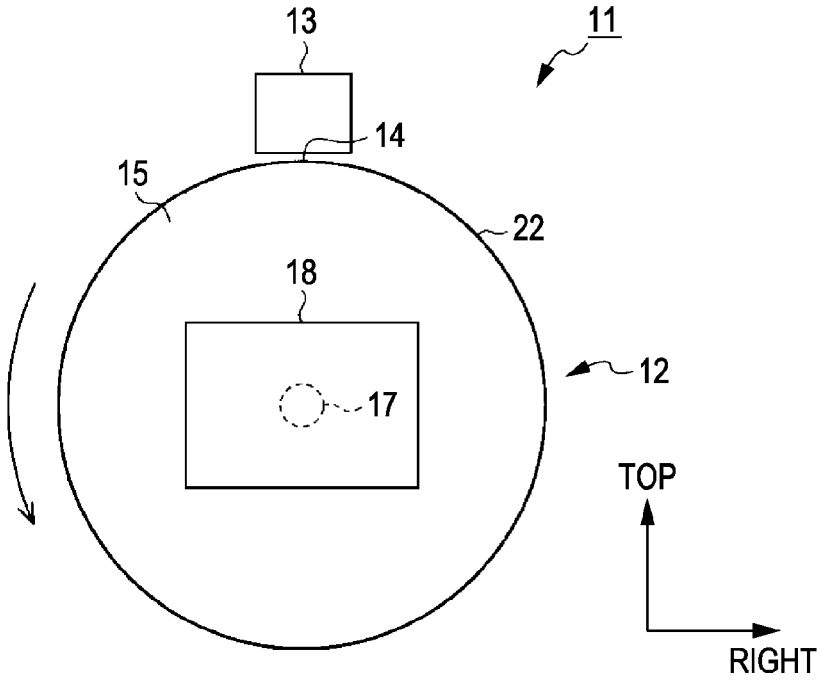
FIG. 3 is a side view of the printer.

As shown in FIGS. 1 to 3, an ink jet printer 11 as a recording apparatus includes a cylindrical body case 12 and a rectangular-parallelepiped-shaped recording head 13 facing the top surface of the body case 12 and serving as a recording unit. The body case 12 includes a cylindrical case 14 having openings at the front and rear ends, a disc-shaped front cap 15 attached so as to close the opening of the case 14 at the front end, and a disc-shaped rear cap 16 attached so as to close the opening of the case 14 at the rear end.

The body case 12 is provided with a main shaft 17 that extends along the axis of the body case 12. That is, the main shaft 17 is provided so as to penetrate through the front cap 15 and the rear cap 16 in the center. The front end and rear end of the main shaft 17 project toward the front side of the front cap 15 and the rear side of the rear cap 16, respectively. A main shaft motor 18 for rotating the main shaft 17 is provided at the front end of the main shaft 17. The front end of the main shaft 17 is rotatably supported by a supporting member (not shown). By driving the main shaft motor 18, the main shaft 17 and the body case 12 are integrally rotated.

Figure 4:
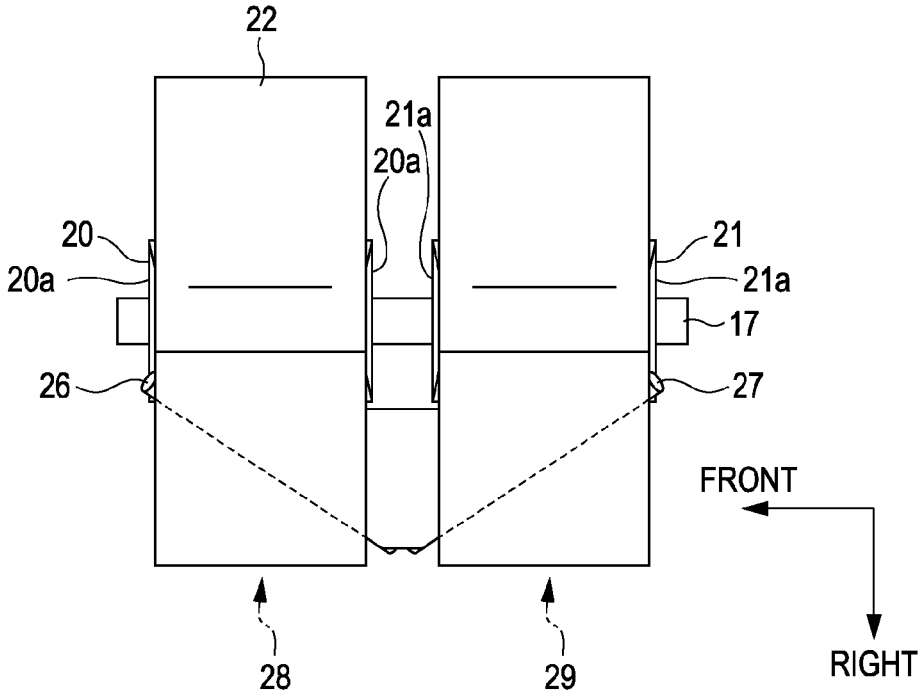
FIG. 4 is a plan view of the printer without a body case and a recording head.

FIG. 4 is a plan view of the ink jet printer 11 without the body case 12 and the recording head 13. As shown in FIGS. 1 and 4, in the case 14, a cylindrical first shaft 20 is provided on the front side of the main shaft 17. That is, the main shaft 17 penetrates through and rotatably supports the first shaft 20. Similarly, in the case 14, a cylindrical second shaft 21 is provided on the rear side of the main shaft 17. That is, the main shaft 17 penetrates through and rotatably supports the second shaft 21. Accordingly, the first shaft 20 and the second shaft 21 are both arranged on the axis of the main shaft 17 extending in the front-rear direction. In other words, the first shaft 20 and the second shaft 21 are arranged side by side on the same axis.

The first shaft 20 is wound with roll paper 22 serving as a long recording medium. The first shaft 20 has, at the front and rear ends, disc-shaped flanges 20*a* for restricting movement of the roll paper 22 in the front-rear direction. Similarly, the second shaft 21 has, at the front and rear ends, disc-shaped flanges 21*a* for restricting movement of the roll paper in the front-rear direction when the roll paper 22 is wound on the second shaft 21.

As shown in FIGS. 1 and 2, a cylindrical driving shaft 19*a* extending along the axis of the main shaft 17 is rotatably inserted in the center of the rear cap 16. The driving shaft 19*a* is connected to the rear end of the second shaft 21 at the front end and to a take-up motor 19 at the rear end. The rear end of the main shaft 17 is movably inserted in the driving shaft 19*a*. The driving of the take-up motor 19 causes the second shaft 21 to rotate via the driving shaft 19*a* but does not cause the main shaft 17 and the body case 12 to rotate.

The case 14 has an opening 23 extending over the entire length in the front-rear direction at the upper end region. The opening 23 provides communication between the inside and outside of the case 14. The right side edge of the opening 23 with respect to the case 14 is a right edge portion 24 and the left side edge of the opening 23 with respect to the case 14 is a left edge portion 25.

Figure 5:
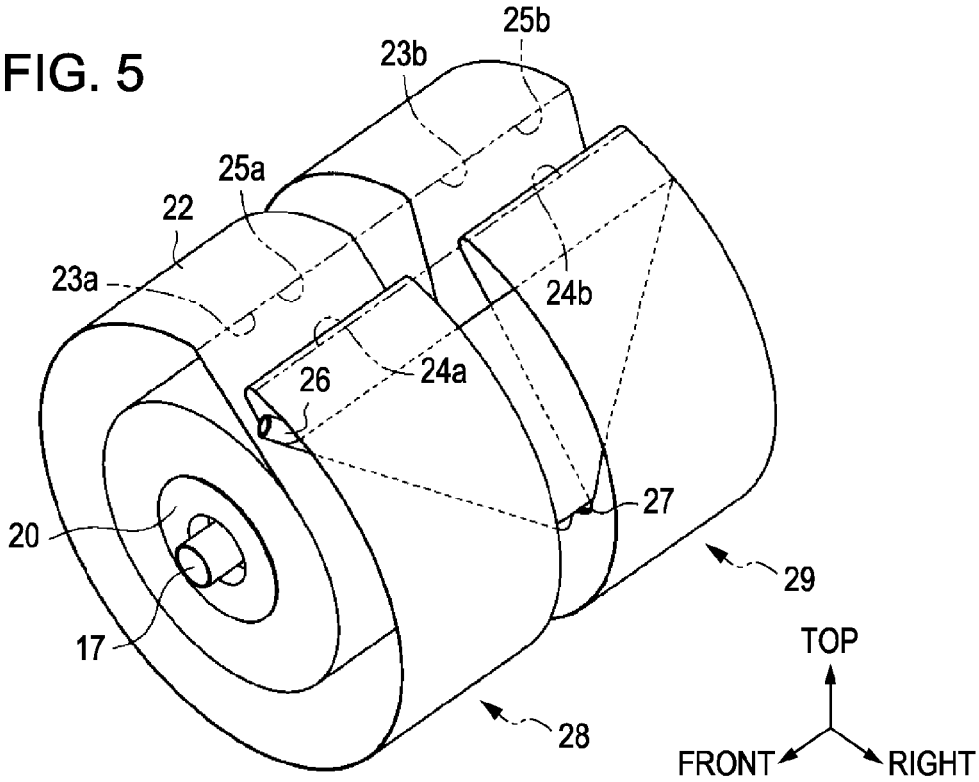
FIG. 5 is a perspective view of the printer without the body case and the recording head, viewed from the front side.
Figure 6:
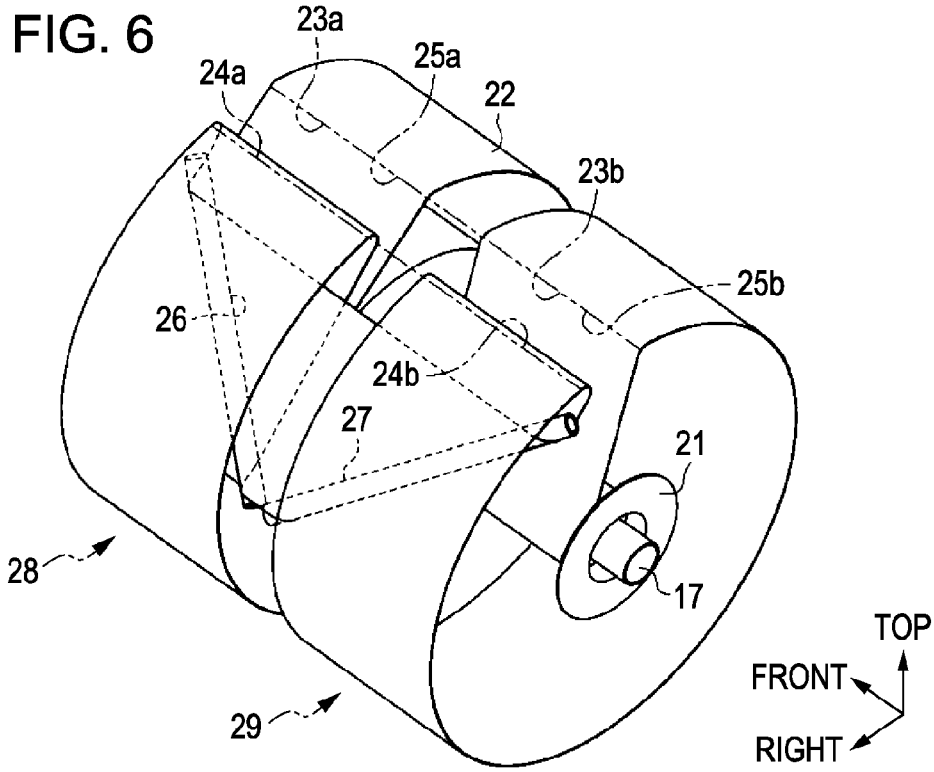
FIG. 6 is a perspective view of the printer without the body case and the recording head, viewed from the rear side.

FIG. 5 is a perspective view of the ink jet printer 11 without the body case 12 and the recording head 13, viewed from the front side. FIG. 6 is a perspective view of the ink jet printer 11 without the body case 12 and the recording head 13, viewed from the rear side. As shown in FIGS. 4 to 6, in the case 14, a first roller 26 extending from the front upper side to the rear lower side as viewed from the diagonally upper right side is provided on the diagonally upper right side of the first shaft 20, and a second roller 27 extending from the front lower side to the rear upper side as viewed from the diagonally upper right side is provided on the diagonally upper right side of the second shaft 21.

In other words, the first roller 26 and the second roller 27 are arranged on the same plane so as to form a V-shape as viewed from the diagonally upper right side. The first roller 26 and the second roller 27 are supported on the inner surface of the case 14 by supporting members (not shown) in a manner capable of rotation about their axes. In this embodiment, the first roller 26 and the second roller 27 constitute a fold-over portion serving as a guide mechanism.

The roll paper 22 drawn from the first shaft 20 is folded over the left edge portion 25, wound around the outer circumference of the case 14, and folded over the right edge portion 24. The roll paper 22 folded over the right edge portion 24 is folded over the first roller 26 from the lower side to the right side so as to be transported rearward and then folded over the second roller 27 from the right side to the lower side so as to be transported in the diagonally upper left direction.

The roll paper 22 folded over the second roller 27 so as to be transported in the diagonally upper left direction is folded over the right edge portion 24, wound around the outer circumference of the case 14, and folded over the left edge portion 25. The roll paper 22 folded over the left edge portion 25 is wound on the second shaft 21 from the right side.

Accordingly, when the second shaft 21 is rotated in the direction in which the roll paper 22 is taken up (i.e., counter-clockwise as viewed from the rear side), the roll paper 22 drawn from the first shaft 20 is transported along the outer circumference of the case 14, sequentially passes the first roller 26 and the second roller 27, again transported along the outer circumference of the case 14, and taken up on the second shaft 21.

As shown in FIG. 1, a region of the outer circumference of the case 14 corresponding to the first shaft 20, around which the roll paper 22 is wound, constitutes a first printing portion 28 serving as a first retainer, and a region of the outer circumference of the case 14 corresponding to the second shaft 21, around which the roll paper 22 is wound, constitutes a second printing portion 29 serving as a second retainer. Accordingly, the first printing portion 28 and the second printing portion 29 are provided side by side in the thrust direction of the case 14 (in this embodiment, the front-rear direction) and retain the roll paper 22 wound in a single layer around them. In this embodiment, the outer surfaces of the roll paper 22 on the first printing portion 28 and on the second printing portion 29 are the same.

In the right edge portion 24 and the left edge portion 25, portions corresponding to the first printing portion 28 constitute a first right edge portion 24*a* and a first left edge portion 25*a*, respectively, and portions corresponding to the second printing portion 29 constitute a second right edge portion 24*b* and a second left edge portion 25*b*, respectively. Furthermore, in the opening 23, a portion corresponding to the first printing portion 28 constitutes a first communication portion 23*a* serving as a communication portion, and a portion corresponding to the second printing portion 29 constitutes a second communication portion 23*b* serving as a communication portion.

In addition, as shown in FIGS. 5 and 6, the first printing portion 28, the portion between the first printing portion 28 and the second printing portion 29, and the second printing portion 29 are made equal in length along the transportation path of the roll paper 22. That is, in the transportation path of the roll paper 22, the portion between the first left edge portion 25*a* and the first right edge portion 24*a*, the portion between the first right edge portion 24*a* and the second right edge portion 24*b*, and the portion between the second right edge portion 24*b* and the second left edge portion 25*b* are made equal in length.

Referring to FIG. 3, the recording head 13 has, in the lower surface facing the outer circumference of the case 14, a plurality of nozzles (not shown) for ejecting ink, serving as a liquid supplied from an ink cartridge (not shown), and an overcoat solution. That is, the recording head 13 ejects ink from the nozzles corresponding to the first printing portion 28 and the overcoat solution from the nozzles corresponding to the second printing portion 29. The overcoat solution serves to protect the printed surface.

By ejecting ink and the overcoat solution from the nozzles in the recording head 13 while rotating the body case 12 counterclockwise (in the direction indicated by the arrow in FIG. 3) about the main shaft 17 as viewed from the front side, printing as a first recording process is performed on a part of the roll paper 22 wound around the first printing portion 28, and coating with the overcoat solution as a second recording process is performed on a part of the roll paper 22 wound around the second printing portion 29.

An operation of the ink jet printer 11 will be described.

When printing is performed on the roll paper 22 using the ink jet printer 11, the roll paper 22 is wound in a single layer around and retained by the first printing portion 28 and second printing portion 29 of the case 14 (a retaining step). Then, the main shaft motor 18 is driven to rotate the body case 12 via the main shaft 17 and the recording head 13 is caused to eject ink from the nozzles onto the first printing portion 28 (a recording step). Thus, printing is performed on the part of the roll paper 22 wound around the first printing portion 28.

When the body case 12 makes one rotation, the take-up motor 19 is driven to rotate the second shaft 21 via the driving shaft 19*a*, allowing the second shaft 21 to take up the roll paper 22 by a length equal to the part of the roll paper 22 wound around the first printing portion 28. As a result of the roll paper 22 being taken up, the first shaft 20 is rotated, allowing the first shaft 20 to feed the roll paper 22 by a length equal to the part of the roll paper 22 taken up by the second shaft 21.

The part of the roll paper 22 wound around the first printing portion 28 is smoothly guided by the first roller 26 and the second roller 27 through the first communication portion 23*a* to the second printing portion 29. At this time, because the first roller 26 and the second roller 27 are rotated along with the transportation of the roll paper 22 folded thereover, the slide resistance exerted on the roll paper 22 when the first roller 26 and the second roller 27 guide the roll paper 22 toward the second printing portion 29 is reduced.

Furthermore, when the roll paper 22 is transported after the body case 12 makes one rotation, the roll paper 22 wound on the first shaft 20 and the second shaft 21 is positioned by the flanges 20*a* and 21*a*. This allows the first shaft 20 to accurately feed the roll paper 22 and the second shaft 21 to accurately take up the roll paper 22 transported from the second printing portion 29.

Thus, the part of the roll paper 22 having undergone the first printing process at the first printing portion 28 moves to a position between the first printing portion 28 and the second printing portion 29, and a part of the roll paper 22 newly drawn from the first shaft 20 moves to the first printing portion 28. Then, similarly, after printing is performed on the part of the roll paper 22 wound around the first printing portion 28, the second shaft 21 takes up the roll paper 22 by a length equal to the part of the roll paper 22 wound around the first printing portion 28. Thus, the part of the roll paper 22 having undergone the first printing process at the first printing portion 28 moves to the second printing portion 29, the part of the roll paper 22 having undergone a second printing process at the first printing portion 28 moves to the position between the first printing portion 28 and the second printing portion 29, and a part of the roll paper 22 newly drawn from the first shaft 20 moves to the first printing portion 28.

After this state is reached, when printing is performed on the part of the roll paper 22 wound around the first printing portion 28 similarly to the above, an overcoat solution is simultaneously ejected from the nozzles in the recording head 13 onto the second printing portion 29. Thus, while the roll paper 22 undergoes a third printing process at the first printing portion 28, the printed surface of the roll paper 22 having undergone the first printing process at the first printing portion 28 is coated with the overcoat solution at the second printing portion 29. Accordingly, printing at the first printing portion 28 and coating of the surface of the roll paper 22 having undergone the printing process at the first printing portion 28 with the overcoat solution are simultaneously performed.

When printing by a length equal to the part of the roll paper 22 wound around the first printing portion 28 is repeated in this manner, as the outside diameter of the roll paper 22 wound on the first shaft 20 decreases, the outside diameter of the roll paper 22 wound on the second shaft 21 gradually increases.

If, as in the known art, the first shaft 20 and the second shaft 21 are arranged in parallel in the direction perpendicular to the axis of the main shaft 17, the balance of the body case 12 during rotation is significantly different between the cases where the outside diameters of the roll paper 22 wound on the first shaft 20 and on the second shaft 21 are significantly different and where they are not. This prevents smooth rotation of the body case 12. In addition, parallel arrangement of the first shaft 20 and the second shaft 21 in the direction perpendicular to the axis of the main shaft 17 requires the inside diameter of the body case 12 to be set large enough to accommodate the first shaft 20 and the second shaft 21, taking into consideration all possible distribution of the roll paper 22 wound on the first shaft 20 and the second shaft 21. Thus, the body case 12 has to be large.

In contrast, in this embodiment, the first shaft 20 and the second shaft 21 are arranged on the axis of the main shaft 17. Therefore, the balance of the body case 12 during rotation is not significantly different between the cases where the outside diameters of the roll paper 22 wound on the first shaft 20 and on the second shaft 21 are significantly different and where they are not. Thus, the body case 12 is smoothly rotated. In addition, because the first shaft 20 and the second shaft 21 are arranged side by side on the axis of the main shaft 17, the inside diameter of the body case 12 can be set large enough to accommodate the first shaft 20 and the second shaft 21, only taking into consideration a situation where the whole roll paper 22 is wound on the first shaft 20 or the second shaft 21. Accordingly, the body case 12 can be made smaller than that of the known art.

According to the first embodiment described in detail above, the following advantages can be obtained.

(1) Because the roll paper 22 sequentially passes the first printing portion 28 and the second printing portion 29, which are separately formed of the outer circumference of the case 14, when it is transported from the first shaft 20 to the second shaft 21 along the transportation path, two recording processes (first and second recording processes), namely, printing on the roll paper 22 and coating of the printed surface of the roll paper 22 with an overcoat solution, can be simultaneously performed.

(2) The first printing portion 28, the portion between the first printing portion 28 and the second printing portion 29, and the second printing portion 29 are made equal in length along the transportation path of the roll paper 22. Thus, by ejecting ink and the overcoat solution on the roll paper 22 while intermittently transporting the roll paper 22 by a length equal to the first printing portion 28, printing on the roll paper 22 at the first printing portion 28 and coating of the printed surface of the roll paper 22 with the overcoat solution at the second printing portion 29 can be simultaneously and assuredly performed.

(3) Because the first roller 26 and the second roller 27 are rotated along with the transportation of the roll paper 22 folded over the first roller 26 and the second roller 27, the slide resistance exerted on the roll paper 22 when the first roller 26 and the second roller 27 guide the roll paper 22 toward the second printing portion 29 is reduced. Accordingly, the roll paper 22 folded over the first roller 26 and the second roller 27 can be smoothly guided to the second printing portion 29.

Second Embodiment

A second embodiment of the invention will be described, focusing on the difference from the first embodiment.

Figure 7:
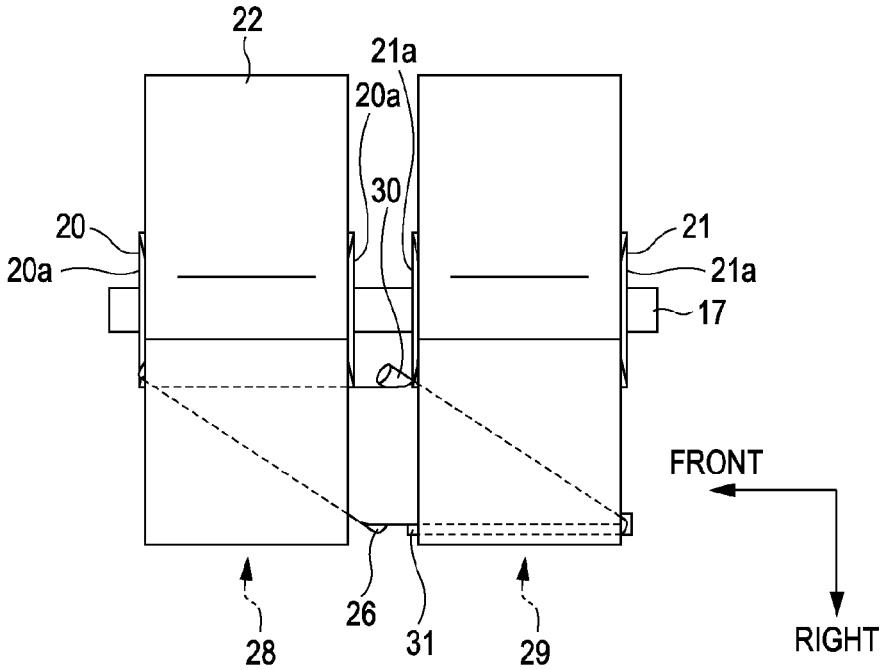
FIG. 7 is a plan view of an ink jet printer according to a second embodiment without a body case and a recording head.
Figure 8:
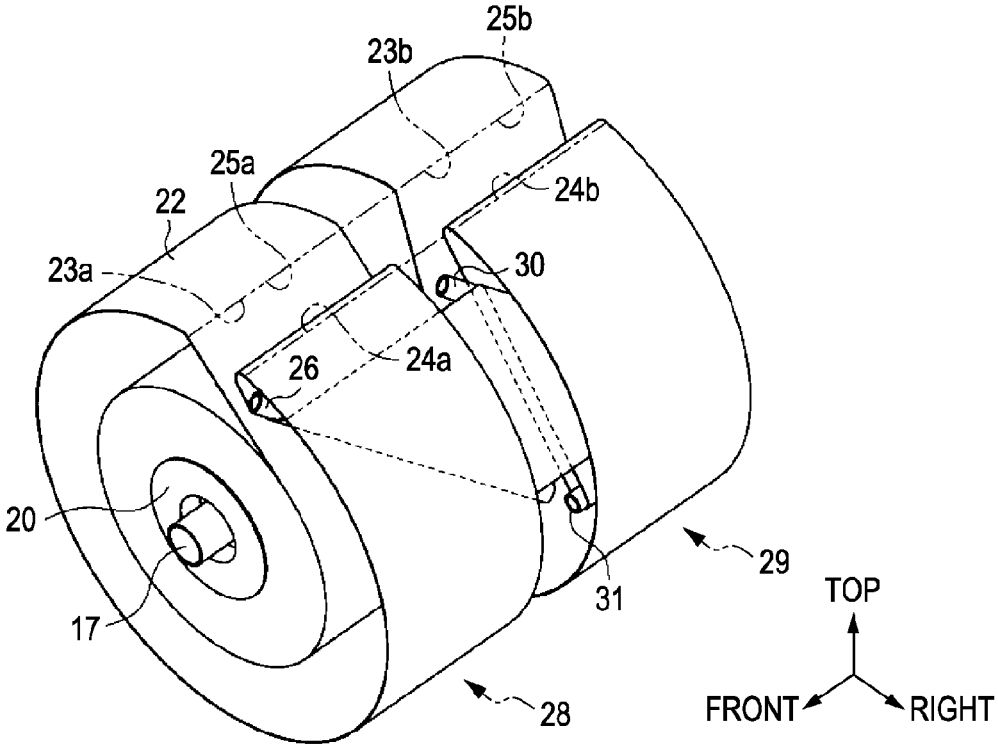
FIG. 8 is a perspective view of the printer without the body case and the recording head, viewed from the front side.
Figure 9:
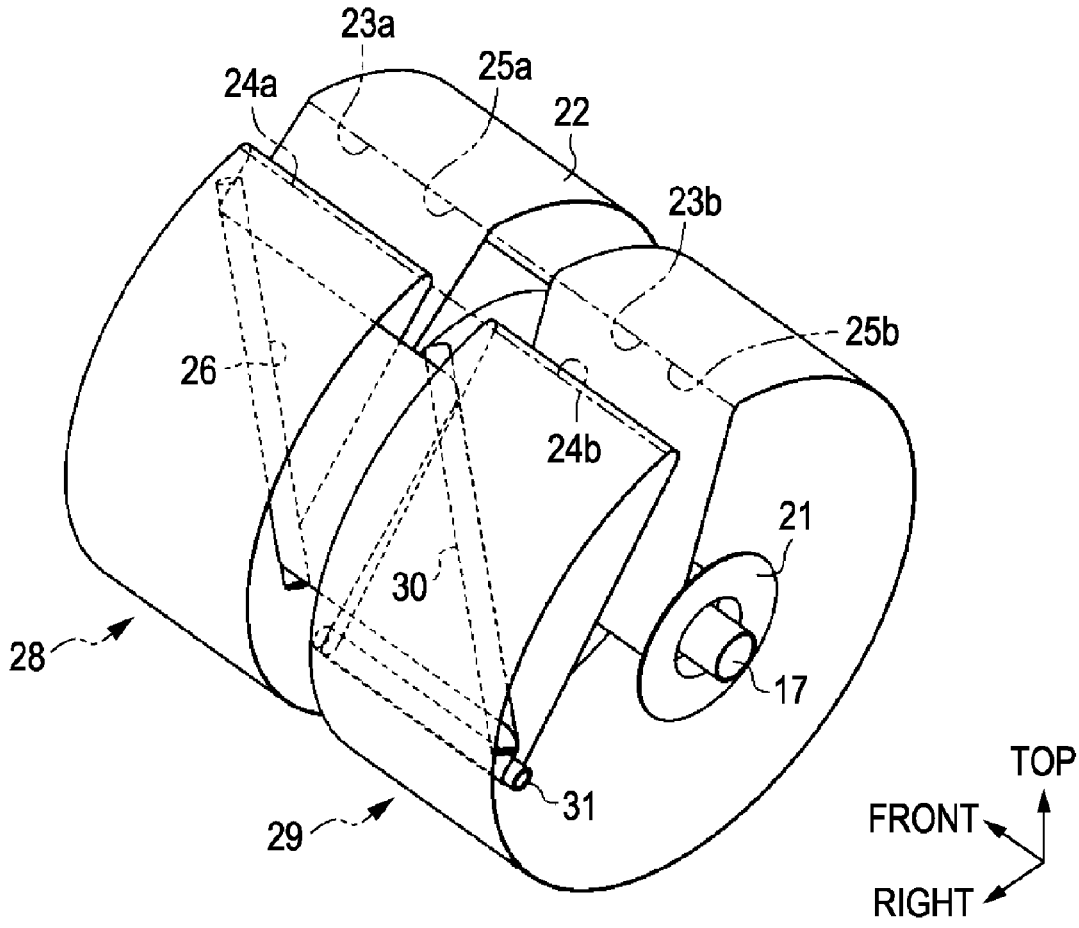
FIG. 9 is a perspective view of the printer without the body case and the recording head, viewed from the rear side.

As shown in FIGS. 7 to 9, in the second embodiment, the second roller 27 according to the first embodiment is replaced by a third roller 30 and a fourth roller 31, and the recording head 13 is configured to eject ink, not an overcoat solution, from the nozzles onto the second printing portion 29.

FIG. 7 is a plan view of the ink jet printer 11 without the body case 12 and the recording head 13. FIG. 8 is a perspective view of the ink jet printer 11 without the body case 12 and the recording head 13, viewed from the front side. FIG. 9 is a perspective view of the ink jet printer 11 without the body case 12 and the recording head 13, viewed from the rear side.

As shown in FIGS. 7 to 9, in the case 14, the third roller 30 extending from the front upper side to the rear lower side as viewed from the diagonally upper right side is provided on the diagonally upper right side of the second shaft 21 so as to extend parallel to the first roller 26. That is, the first roller 26 and the third roller 30 are arranged on the same plane. In addition, in the case 14, on the right side of the second shaft 21, the fourth roller 31 extending parallel to the second shaft 21 is provided on the diagonally lower left side of and adjacent to the lower end (rear end) of the third roller 30. The third roller 30 and the fourth roller 31 are rotatably supported on the inner surface of the case 14 by supporting members (not shown). In this embodiment, the first roller 26, the third roller 30, and the fourth roller 31 constitute a fold-over portion serving as a guide mechanism.

The roll paper 22 drawn from the first shaft 20 is folded over the first left edge portion 25*a*, wound around the first printing portion 28, and folded over the first right edge portion 24*a*. The roll paper 22 folded over the first right edge portion 24*a* is folded over the first roller 26 from the lower side to the right side so as to be transported rearward, and folded over the third roller 30 from upper side to the left side so as to be transported downward.

The roll paper 22 folded over the third roller 30 so as to be transported downward is then folded over the fourth roller 31 from the right side to the lower side so as to be transported upward. The roll paper 22 folded over the fourth roller 31 so as to be transported upward is folded over the second right edge portion 24*b*, wound around the second printing portion 29, and folded over the second left edge portion 25*b*. The roll paper 22 folded over the second left edge portion 25*b* is wound on the second shaft 21 from the right side.

Accordingly, when the second shaft 21 is rotated in the direction in which the roll paper 22 is taken up (i.e., counterclockwise as viewed from the rear side), the roll paper 22 drawn from the first shaft 20 is transported along the first printing portion 28, sequentially passes the first roller 26, the third roller 30, and the fourth roller 31, transported along the second printing portion 29, and taken up on the second shaft 21.

The roll paper 22 is reversed as it sequentially passes the first roller 26, the third roller 30, and the fourth roller 31. Thus, in this embodiment, the outer surfaces of the roll paper 22 on the first printing portion 28 and on the second printing portion 29 are different.

As shown in FIGS. 8 and 9, similarly to the first embodiment, the first printing portion 28, the portion between the first printing portion 28 and the second printing portion 29, and the second printing portion 29 are made equal in length along the transportation path of the roll paper 22.

Although the ink jet printer 11 performs printing on the roll paper 22 in the same manner as the first embodiment, in this embodiment, the roll paper 22 is reversed by the rollers 26, 30, and 31 while being transported from the first printing portion 28 to the second printing portion 29. Thus, printing is performed on the front surface of the roll paper 22 at the first printing portion 28 and on the back surface of the roll paper 22 at the second printing portion 29. That is, the front and back surfaces of the roll paper 22 are printed simultaneously. Accordingly, in this embodiment, double-face printing of the roll paper 22 is efficiently performed.

According to the second embodiment described in detail above, the following advantages can be obtained.

(4) Because the roll paper 22 is reversed by the rollers 26, 30, and 31 while being transported from the first printing portion 28 to the second printing portion 29, double-face printing of the roll paper 22 can be efficiently performed.

Modification

The above-described embodiments may be modified as follows.

At least one of the rollers 26, 27, 30, and 31 may be replaced by a non-rotatable round bar or round pipe. In such a case, the roll paper 22 folded over the round bar or the round pipe is transported while being slid along the surface of the round bar or round pipe.

The first shaft 20 and the second shaft 21 do not necessarily have to be arranged on the same axis.

The first shaft 20 and the second shaft 21 do not necessarily have to be arranged on the axis of the main shaft 17.

The first printing portion 28, the portion between the first printing portion 28 and the second printing portion 29, and the second printing portion 29 do not necessarily have to be made equal in length along the transportation path of the roll paper 22.

The first embodiment may be configured such that ink, instead of the overcoat solution, is ejected onto the roll paper 22 at the second printing portion 29. In such a case, for example, the entire surface of the roll paper 22 is subjected to solid printing at the first printing portion 28, and an image, a character, or the like is printed thereon with an ink different from that used in the solid printing at the second printing portion 29.

In addition to the first printing portion 28 and the second printing portion 29, one ore more printing portions serving as retainers that retain the roll paper 22 wound around them may be provided on the outer circumference of the case 14. In such a case, a guide mechanism is provided at each position between the printing portions in the transportation path of the roll paper 22. In addition, a given guide mechanism may be configured to reverse the roll paper 22. This allows three or more recording processes, such as printing, to be performed on the roll paper 22.

The body case 12 may be divided into a front part and a rear part between the first printing portion 28 and the second printing portion 29. In other words, the body case 12 having the first printing portion 28 and the body case 12 having the second printing portion 29 may be separated.

The first shaft 20 and the second shaft 21 do not necessarily have to be accommodated in the body case 12. That is, the first shaft 20 and the second shaft 21 may be arranged outside the body case 12. In such a case, additional guide mechanisms for guiding the roll paper 22 from the first shaft 20 to the first printing portion 28 and from the second printing portion 29 to the second shaft 21 are required.

The body case 12 may be a column-shaped or elliptic-column-shaped solid body. In such a case, the guide mechanisms, the first shaft 20, and the second shaft 21 are disposed on the outer surface of the solid body or at positions away from the solid body.

The second shaft 21 may be omitted so that the roll paper 22 having undergone the second recording process at the second printing portion 29 is cut into pieces having a predetermined length and collected in a stacked state.

The first shaft 20 may be omitted. In such a case, instead of the roll paper 22, a long belt-like continuous paper folded like bellows may be used as a recording medium.

Although the recording apparatus is embodied as the ink jet printer 11 in the above-described embodiments, the recording apparatus may be embodied as a printer employing a plate-printing method.

Although the recording apparatus is embodied as the ink jet printer 11 in the above-described embodiments, the recording apparatus may be embodied as a liquid ejecting apparatus that ejects liquid other than ink (including a liquid material in which particles of a functional material are dispersed or mixed, and a fluid material such as a gel). Herein, the term "liquid" includes inorganic solvent, organic solvent, solution, liquid resin, liquid metal (molten metal), liquid material, and fluid material.

What is claimed is:

1. A recording apparatus comprising:

a first retainer and a second retainer arranged side by side in a thrust direction, the first and second retainers being rotatable and retaining a long recording medium wound therearound;

a guide mechanism that draws the recording medium wound around the first retainer in the thrust direction and guides the recording medium in a direction in which the recording medium can be wound around the second retainer;

a recording unit that performs a first recording process on the recording medium wound in a single layer around and retained by the first retainer under rotation of the first retainer and a second recording process on the recording medium wound in a single layer around and retained by the second retainer under rotation of the second retainer, wherein the recording medium wound in a single layer around and retained by the first retainer is equal in length in a transport direction of the recoding medium as the recording medium wound in a single layer around and retained by the second retainer;

a rotatable hollow body case having a plurality of communication portions providing communication between an inside and an outside of the body case;

a first shaft that is accommodated in the body case and supports the recording medium wound in a roll shape in a manner that the recording medium can be fed from the inside to the outside of the body case through the communication portion positioned at an upstream side of a transportation path of the recording medium among the communication portions; and a second shaft that is accommodated in the body case and is capable of taking up the recording medium introduced from the outside to the inside of the body case through the communication portion positioned at a downstream side of the transportation path of the recording medium among the communication portions, wherein the guide mechanism guides the recording medium introduced from the outside to the inside of the body case through the communication portion on the upstream side of the guide mechanism from the inside to the outside of the body case through the communication portion on the downstream side of the guide mechanism, wherein the recording medium drawn from the inside to the outside of the body case through the communication portions is wound around separate regions of an outer circumference of the body case, the separate regions being arranged in the thrust direction, and introduced from the outside to the inside of the body case through the communication portions, and wherein the first retainer and the second retainer are formed of the separate regions of the outer circumference of the body case.

2. The recording apparatus according to claim 1, wherein the guide mechanism is capable of reversing the recording medium so as to change the surface of the recording medium subjected to the recording processes at the retainers and is formed of a fold-over portion over which the recording medium is folded so as to change a transportation direction of the recording medium, and wherein the fold-over portion is formed of a roller rotatably supported about an axis.

3. The recording apparatus according to claim 1, wherein the recording medium wound in a single layer around and retained by the first retainer is equal in length in a transport direction of the recoding medium as the recording medium between the recording medium retained by the first retainer and the recording medium retained by the second retainer.

* * * * *